US005803315A

United States Patent [19]

Kaufman

[11] Patent Number: 5,803,315

[45] Date of Patent: Sep. 8, 1998

[54] DISPENSER HAVING REMOVABLE CONTAINER

[75] Inventor: John G. Kaufman, Burlington, Canada

[73] Assignee: Kaufman Products Inc., Oakville, Canada

[21] Appl. No.: 779,317

[22] Filed: Jan. 6, 1997

[51] Int. Cl.[6] ..... B65D 37/00

[52] U.S. Cl. ..... 222/183; 222/207

[58] Field of Search ..... 222/207, 209, 222/212, 214, 183, 185.1

[56] References Cited

U.S. PATENT DOCUMENTS

| | | | |
|---|---|---|---|
| 1,995,215 | 3/1935 | Mehlsen et al. . | |
| 2,680,010 | 6/1954 | Dubay | 261/124 |
| 3,422,993 | 1/1969 | Boehm et al. | 222/190 |
| 3,622,049 | 11/1971 | Thompson | 222/190 |
| 3,709,437 | 1/1973 | Wright | 239/343 |
| 3,985,271 | 10/1976 | Gardner | 222/190 |
| 4,018,364 | 4/1977 | Wright | 222/190 |
| 4,022,351 | 5/1977 | Wright | 222/145 |
| 4,147,306 | 4/1979 | Bennett | 239/327 |
| 4,184,615 | 1/1980 | Wright | 222/190 |
| 4,324,349 | 4/1982 | Kaufman | 222/207 |
| 4,429,834 | 2/1984 | Ito | 239/327 |
| 4,432,496 | 2/1984 | Ito | 239/327 |
| 4,635,828 | 1/1987 | Kaufman | 222/185 |
| 4,645,097 | 2/1987 | Kaufman | 222/207 |
| 4,957,218 | 9/1990 | Ford, Jr. | 222/1 |
| 5,033,653 | 7/1991 | Kaufman | 222/185 |
| 5,217,147 | 6/1993 | Kaufman | 222/185 |
| 5,261,571 | 11/1993 | Gonclaves | 222/183 |
| 5,427,279 | 6/1995 | Kaufman | 222/207 |
| 5,529,217 | 6/1996 | Siegel | 222/212 |
| 5,544,788 | 8/1996 | Meyer | 222/110 |
| 5,590,817 | 1/1997 | Kaufman | 222/207 |

*Primary Examiner*—Philippe Derakshani
*Attorney, Agent, or Firm*—Rogers & Scott

[57] ABSTRACT

A dispenser for liquids is provided having a container including a bottom opening and an envelope structure surrounding the container. A bottom wall on the envelope structure is adjacent the bottom opening so that liquid from the container will collect in the envelope structure about the bottom opening. A dispensing passage is coupled to the envelope structure and leads from inside the envelope structure below the bottom opening upwardly and terminates outside the envelope structure. At least a portion of the envelope structure is resiliently deformable for deflection to create pressure in liquid in the envelope structure to thereby cause liquid to exit through the dispensing passage.

15 Claims, 1 Drawing Sheet

DISPENSER HAVING REMOVABLE CONTAINER

FIELD OF THE INVENTION

This invention relates to dispensers for liquids, the dispensers being operable manually or by a suitable actuator to cause dispensing. The dispenser includes a removable container which can be refilled or replaced when the liquid in the dispenser has been exhausted.

BACKGROUND OF THE INVENTION

Products in liquid form have for many years been packaged in a variety of containers suitable for shipping, displaying, handling and eventual sale. These containers have been made in a great variety of shapes and sizes with different types of closures. They include glass containers, and containers of synthetic plastics materials which have been molded and generally formed into shape. Also, because of the nature of these plastics materials, the closures can be of many various types including screw caps, flip tops, and simple bonded seals. In general, containers of these types have been made to enhance the product and little thought was given to disposing of the container.

More recently it has become common practice to recycle materials wherever possible, and there is a growing impetus to reduce the amount of packaging material used in selling products so that recycling will be minimized.

There are several approaches being explored by manufacturers of packaged liquids. A first is to make larger containers available to encourage the end user to purchase product in larger quantities because the ratio of packaging material to product tends to be reduced as the volume of product increases. Such an approach leads the consumer towards using a refillable container which is retained on site and refilled from the larger container.

An alternative approach is to package liquid products in inexpensive and simple containers which can be readily recycled and which are made from a minimum of material. Such containers would be used as refills for a dispenser having an appearance designed to be in keeping with the surroundings.

The present invention provides structures which can take advantage of both approaches. The structures use principles taught in the present inventor's earlier filed applications for inventions which have matured into patents including U.S. patent application Ser. Nos. 4,324,349; 4,635,828; 4,645,097; and 5,033,653. These patents teach dispensers having no moving parts and yet satisfying the requirements of clean dispensing. In addition, the dispensers incorporate structure to accommodate temperature changes so that they may be subjected to a designed temperature range without inadvertent dripping or dispensing caused by such temperature changes. This effect has been described in these patents as "temperature compensation".

The structures shown in the applicant's earlier patents are simple, and relatively inexpensive to manufacture. The dispensers have a reservoir containing some of the liquid to be dispensed and in communication with the main part of the dispenser which is in the form of a resilient container where the major volume of the liquid is contained. Air is trapped above the liquid in the container under a negative pressure which prevents the liquid flowing through the container into the reservoir and out through a discharge passageway. When the user applies a force to deform the container, the negative pressure is overcome to some extent so that the liquid will flow out of the container and into the reservoir, then out via the passageway. As soon as the force on the container is released, the walls of the container will return to their original shape so that negative pressure is again created above the liquid in the container. As a result, air is sucked back into the passageway and the container is set up in a new condition of equilibrium. As the air is sucked back, liquid is cleaned out from the passageway, and some of the air finds its way through the liquid to finish above the liquid in the container and some remains in the reservoir. It is the air in the reservoir which effectively provides the temperature compensation. As temperature increases, the negative pressure above the liquid in the container becomes more positive resulting in the flow of some liquid into the reservoir. Liquid will consequently rise in the reservoir and displace air out of the passageway. This action can continue within a designed temperature range without causing liquid to pass through the discharge passageway.

U.S. Pat. No. 5,033,653 teaches an improvement over the earlier patented inventions by Kaufman in which the concept of temperature fluctuation is separated as a parameter from response rate. This is achieved by a small opening providing communication between the container and atmosphere so that as temperature changes, air will flow slowly through the opening to maintain atmospheric pressure in the reservoir. By contrast, when a user activates the dispenser, pressure in the reservoir is increased quite suddenly. However very little air will escape through the hole before the dispensing action is finished so that the hole has no noticeable effect on the dispensing action.

The structures shown in applicant's earlier patents included containers which were subjected to negative pressure induced by the negative pressure head in the container. Dispensing was caused by deforming the container inwardly. Consequently these containers have to meet two conflicting design parameters. Firstly, the container must be sufficiently stiff and strong to resist collapsing inwardly under the influence of the negative pressure, and secondly, the container must respond to manual squeezing to dispense. Clearly, the latter criterion suggests that the container should present a soft, pleasing tactile feel to the user, but because of the first design criterion such characteristics can not be achieved without sacrificing strength and stiffness.

SUMMARY OF THE INVENTION

A dispenser for liquids is provided having a container including a bottom opening and an envelope structure surrounding the container. A bottom wall on the envelope structure is adjacent the bottom opening so that liquid from the container will collect in the envelope structure about the bottom opening. A dispensing passage is coupled to the envelope structure and leads from inside the envelope structure below the bottom opening upwardly and terminates outside the envelope structure. At least a portion of the envelope structure is resiliently deformable for deflection to create pressure in liquid in the envelope structure to thereby cause liquid to exit through the dispensing passage.

BRIEF DESCRIPTION OF THE DRAWINGS

The invention will be better understood with reference to the following description taken in consideration with the drawings in which.

Figure 1:
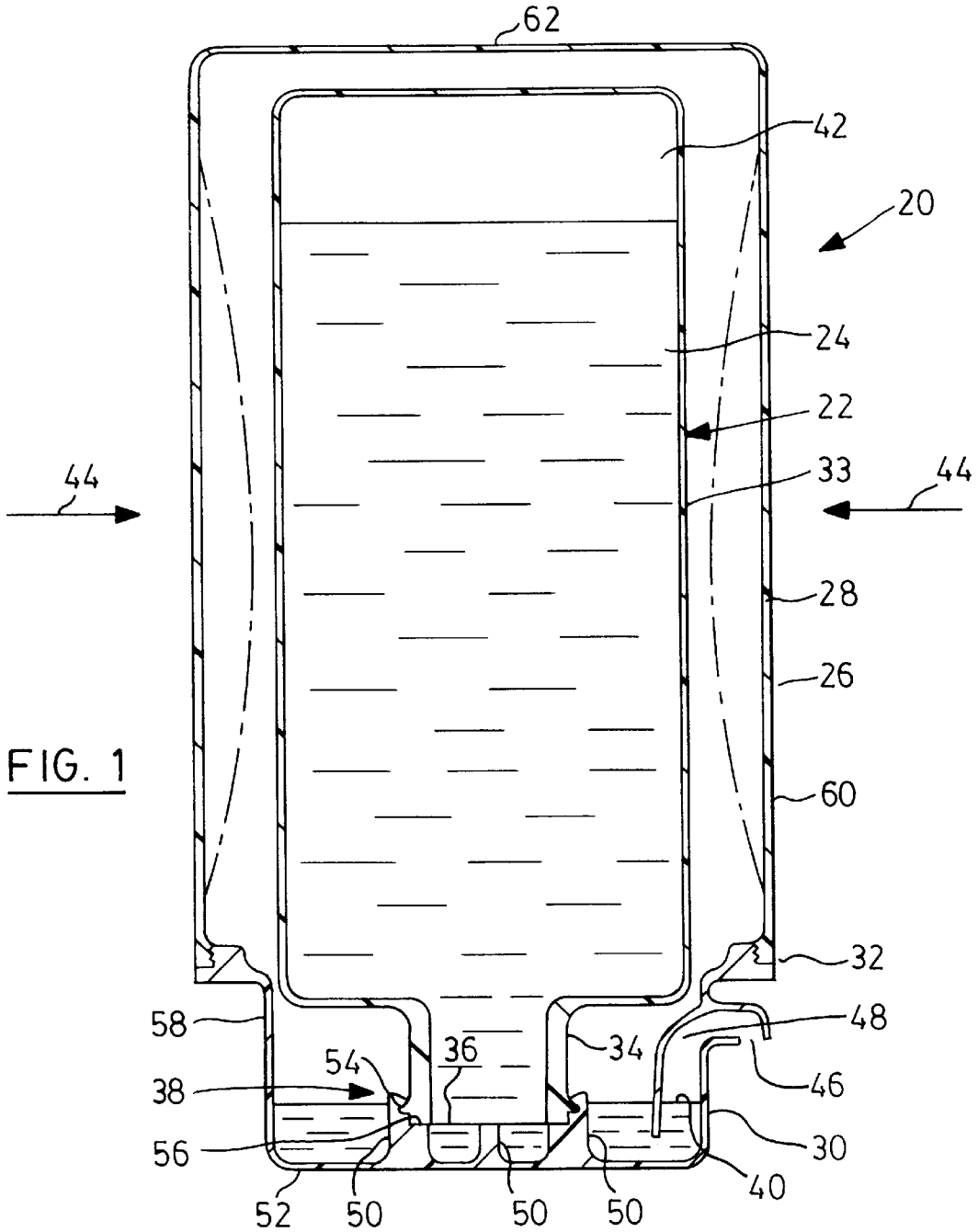
FIG. 1 is a sectional side view of a preferred embodiment of a dispenser according to the invention and containing a liquid to be dispensed.

Reference is first made to FIG. 1 which illustrates a dispenser designated generally by the numeral 20 and consisting essentially of a container 22 for liquid 24 surrounded by an envelope structure 26 made up of an upper part 28 and a lower part 30. The upper and lower parts 28, 30 are releasably coupled to one another at a threaded joint 32.

The container 22 includes a main portion 33 and a downwardly extending neck 34 terminating at a bottom opening 36 contained in the lower part 30 with the neck located on and supported by a location structure designated generally by the numeral 38.

With the container 22 in the position shown in FIG. 1, liquid from the container will flow into the lower part 30 and reach a level 40 which is slightly above the bottom opening 36 thereby trapping liquid in the container and preventing further flow. Consequently a negative pressure will build up in an air space 42 above the liquid 24 and this position of equilibrium will continue until disturbed by the user.

When the user wishes to dispense liquid from the dispenser, the upper part 28 is squeezed in the direction of the arrows 44 to deform into the position shown in ghost outline. The result is a reduction in volume of the envelope structure 26 thereby applying a slight pressure on the liquid level 40 with the result that liquid will be forced towards a discharge opening 46 forming part of a dispensing passage 48. When dispensing is to be ended, the user will release pressure on the upper part 28 with the result that the resilient walls of this part will return to their original position thereby increasing the volume of the envelope structure 26 and drawing air inwardly through the dispensing passage 48 to replace the liquid that has been dispensed. Equilibrium will again be sought by the structure resulting in the level 40 being reestablished ready for further dispensing.

In use, the dispenser is loaded by first separating the upper part 28 from the lower part 30 at the threaded joint 32. With the lower part in the position shown in FIG. 1, the container 22 full of liquid is quickly inverted and placed in the location structure 38 in the lower part 30. This structure consists of four upright fingers 50 attached to a bottom wall 52 and spaced equally to receive the neck 34 of the container 22. The neck defines a peripheral rib 54 and the fingers define recesses for engaging the rib for positive location. To supplement this, each of the fingers also defines a step 56 to engage the end of the neck for better location. As a result, if the user applies a slight force downwardly, the container 22 will be positioned relative to the lower part 30.

The lower part 30 also includes a peripheral wall 58 extending upwardly from the bottom wall 52 and terminating at the threaded joint 32 where it meets a side wall 60 of the upper part 28. This wall continues upwardly ending at a top wall 62 to complete the envelope structure. The user covers the container 22 by placing the upper part 28 over the lower part 30 and engaging the threaded joint 32. Once this is completed, then the dispenser is ready for operation to move liquid through the dispensing passage 48 which passes through the peripheral wall 58 of the lower part 30. It will be appreciated that in the structure shown in FIG. 1, the container 22 functions only to contain the liquid. It can therefore be a very simple structure using minimum material. It can vary from a rigid structure to one that has some resilience but is sufficiently rigid to maintain its shape under the influence of negative pressure in the space 42. It is envisaged that the structure could be a thin walled ribbed and blow-molded bottle having minimum cost and simply used to transport liquid from the point of purchase to the dispenser where it is then contained in the envelope structure 26 which of course can be decorative and relatively well made because it is reusable.

When the user applies a force in the direction of the arrows 44, unlike previous products of this type where the container is squeezed in this manner, the container 22 is unaffected by the squeezing and pressure is created on the level 40 of liquid in the lower part 30 to cause dispensing. This results in repeatable dispensing because in every instance the user is applying a force which, for a given force, will displace the same amount of air and cause the same dispense. To emphasize this, the container 22 can be arranged to act as a stop to limit the deflection of the upper part 28 so that the change of volume in the upper part 28 tends to be constant for all dispensing actions.

Earlier structures required the user to apply a force directly to the container which resulted in different dispensing characteristics depending upon whether the container is full or nearly empty. Although this variation can be quite acceptable for most products, the present invention has the advantage that the dispensing will be essentially repeatable throughout the dispensing cycle to empty the container.

A further advantage of the present structure is that the liquid in the container tends to fall under the action of gravity so that as the container is emptied the liquid will flow down the walls and leave the walls clean. Also, the user will be able to dispense liquid even after all of the liquid has left the container and liquid remains only in the lower part 30. Consequently, when the container 22 is to be either refilled or replaced, it will be removed from the dispenser in a very clean condition. This has great advantages in recycling as well as ensuring that the user is not wasting liquid.

Figure 2:
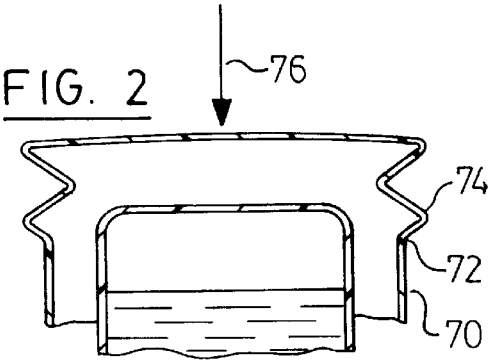
FIG. 2 is a view similar to FIG. 1 and showing an alternative embodiment of an upper portion of the dispenser.

The dispenser 20 can take many forms. For instance, the resilient portion of the envelope structure 26 has been shown as a deformable side wall 60 in the upper part 28. Various other approaches are possible, including permitting flexibility in the lower part. Another example is shown in FIG. 2 as an alternative embodiment when a different action is to be preferred. As seen in FIG. 2, an envelope structure 70 is provided including an upper part 72 having a bellows 74. The user can apply a load downwardly in the direction of the arrow 76 to deform the bellows and thereby change the volume of the envelope structure 70 in the manner described with reference to FIG. 1. This structure has advantages for larger dispensers which will not be picked up for dispensing but rather left in position and the user simply applies a downward load.

Figure 3:
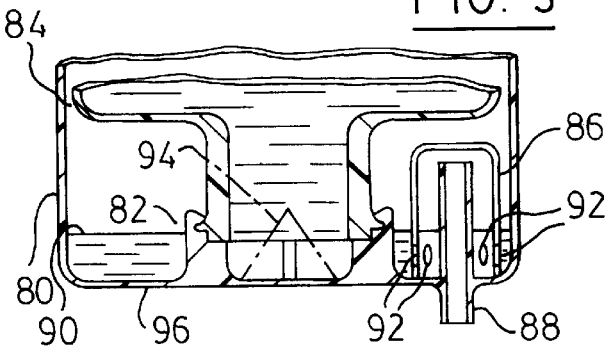
FIG. 3 is a view similar to FIG. 1 and showing an alternative embodiment of a lower portion of the dispenser.

In some instances it will be desirable to dispense from the bottom. A suitable structure is shown in FIG. 3. In this case, an envelope structure 80 has a location structure 82 supporting a container 84. A bell-shaped dispensing passage 86 includes a downwardly extending tube 88 extending from a level above a liquid level 90. Access is provided into the dispensing passage via openings 92 and when the user creates a change in volume in the envelope structure 80, the liquid level 90 will rise to reach the top of the tube 88 and then dispensing will take place downwardly through the tube. The liquid level is made to go upwardly initially in the same manner as that in the embodiment shown in FIG. 1 although the dispensing passage will then reverse downwardly rather than continue upwardly as shown in FIG. 1.

Various modifications described with reference to FIGS. 2 and 3 can be incorporated into various embodiments and of course both the bellows 74 and the downwardly extending dispensing passage 86 can appear in the same embodiment.

Another variation to the structures which may be desirable in some circumstances is shown in ghost outline in FIG. 3. An upright tooth 94 projects from a bottom wall 96 between parts of the location structure 82 and proportioned to enter the neck of container 84 as the container is entered into the lower part of envelope structure 80. The tooth is shaped to sever a seal placed over the opening in the neck (not shown) so that a sealed container can be inverted and as it reaches its final position in the location structure 82, the seal will be severed and liquid can flow from the container.

These and other embodiments are within the scope of the invention as described and claimed.

What is claimed is:

1. A dispenser for liquids, the dispenser including:

a container for a liquid to be dispensed, the container having a bottom opening;

an envelope structure surrounding the container, the structure having an upper part and a lower part coupled to the upper part, at least a portion of the envelope structure being resiliently deformable for actuating the dispenser, and the lower part having a bottom wall and a peripheral wall extending upwardly from the bottom wall;

location structure attached to the bottom wall of the lower part and extending upwardly to support the container with the bottom opening of the container spaced from the bottom wall sufficiently to permit a pool of liquid to accumulate in the lower part with the bottom opening immersed in the liquid thereby trapping liquid in the container; and a dispensing passage coupled to the lower part and extending upwardly from below said bottom opening and terminating outside the envelope structure whereby a user can actuate the dispenser by deforming said portion of the envelope structure to apply pressure on the surface of the pool of liquid to thereby cause liquid to exit via the dispensing passage and when said portion is released, to cause air to be sucked back into the dispenser and to allow the dispenser to return to the original shape.

2. A dispenser as claimed in claim 1 in which the upper part has a resilient side wall extending upwardly from the lower part of the envelope structure and in which said portion of the envelope structure is a portion of the side wall of the upper part.

3. A dispenser as claimed in claim 1 in which said portion of the envelope structure is a resiliently deformable bellows operable by pushing downwardly on the dispenser to dispense liquid.

4. A dispenser as claimed in claim 1 in which the container includes a neck extending downwardly and terminating at the bottom opening, and in which the location structure and the neck of the container include complementary structure to locate the container in the lower part of the envelope structure.

5. A dispenser as claimed in claim 1 in which the dispensing passage passes through the peripheral wall of the lower part of the envelope structure.

6. A dispenser as claimed in claim 1 in which the dispensing passage passes through the bottom wall of the lower part of the envelope structure.

7. A dispenser as claimed in claim 1 in which the upper and lower parts of the envelope structure are releasably coupled for separation to permit replacement of the container.

8. A dispenser as claimed in claim 1 in which the container is a relatively rigid structure.

9. A dispenser as claimed in claim 1 in which the container is sufficiently rigid to resist negative pressure caused by the weight of the liquid in the container.

10. A dispenser as claimed in claim 1 in which the lower part includes an upright tooth positioned to enter the neck of the container, as the container is assembled in the lower part, for severing a seal over the bottom of the neck.

11. A dispenser as claimed in claim 2 in which the lower part includes an upright tooth positioned to enter the neck of the container, as the container is assembled in the lower part, for severing a seal over the bottom of the neck.

12. A dispenser as claimed in claim 3 in which the lower part includes an upright tooth positioned to enter the neck of the container, as the container is assembled in the lower part, for severing a seal over the bottom of the neck.

13. A dispenser for liquids, the dispenser including:

a container having a bottom opening;

an envelope structure surrounding the container and having a bottom wall, the container bottom opening being adjacent the bottom wall so that liquid from the container will collect in the envelope structure about the bottom opening;

a dispensing passage coupled to the envelope structure and leading from inside the envelope structure below the bottom opening upwardly and terminating outside the envelope structure; and at least a portion of the envelope structure being resiliently deformable for deflection to create pressure in the liquid in the envelope structure to thereby cause liquid to exit through the dispensing passage.

14. A dispenser as claimed in claim 13 in which the container is sufficiently rigid to resist negative pressure caused by the weight of the liquid in the container.

15. A dispenser as claimed in claim 13 in which the container is resiliently deformable and in which said resilient portion of the envelope structure is adjacent the container so that when said resilient portion is deflected, the container may be deflected after engagement of the resilient portion with the container by further deflection of the resilient portion.

* * * * *